United States Patent [19]

Meier et al.

[11] 4,385,715

[45] May 31, 1983

[54] ROTARY SLIDING CLOSURE UNIT AND LIQUID MELT CONTAINER EMPLOYING THE SAME

[75] Inventors: Ernest Meier, Wollerau; Herbert Bachmann, Ebikon, both of Switzerland

[73] Assignee: Stopinc Aktiengesellschaft, Baar, Switzerland

[21] Appl. No.: 260,724

[22] Filed: May 5, 1981

[30] Foreign Application Priority Data

May 22, 1980 [CH] Switzerland ..... 4011/80

[51] Int. Cl.[3] ..... B22D 41/08

[52] U.S. Cl. ..... 222/598; 222/555; 251/188

[58] Field of Search ..... 251/188; 222/598, 600, 222/548, 555

[56] References Cited

U.S. PATENT DOCUMENTS 4,194,528 3/1980 Kepler ..... 251/188 X

FOREIGN PATENT DOCUMENTS 1910247 9/1970 Fed. Rep. of Germany ..... 222/598

2043588 3/1972 Fed. Rep. of Germany ..... 222/598

*Primary Examiner*—David A. Scherbel

*Attorney, Agent, or Firm*—Wenderoth, Lind & Ponack

[57] ABSTRACT

A rotary sliding closure unit for use in a liquid melt container extends inwardly through the jacket of the container and into the lining thereof to selectively block and unblock a pouring opening of the container. The unit includes a stationary refractory plate positioned within the lining and having therethrough a flow passage in communication with the pouring opening, and a rotary refractory plate positioned in sliding abutting contact with the stationary refractory plate and having therethrough at least one flow passage to be selectively moved into and out of alignment with the flow passage of the stationary refractory plate. The two refractory plates have complementary abutting relative sliding surfaces located within the interior of the jacket of the container. A stationary tube member extends through the jacket and into the lining and has an inner end grasping the stationary refractory plate. An intermediate member fixes the rotary refractory plate, and a rotary tube member extends through the jacket coaxially within the stationary tube member. The intermediate member is fixed with respect to the inner end of the rotary tube member to rotate therewith, but to enable relative axial movement therebetween. The intermediate member is axially urged away from the rotary tube member to thus urge the rotary refractory plate into pressure contact against the stationary refractory plate.

39 Claims, 2 Drawing Figures

ROTARY SLIDING CLOSURE UNIT AND LIQUID MELT CONTAINER EMPLOYING THE SAME

BACKGROUND OF THE INVENTION

The present invention relates to an improved rotary sliding closure unit and to a liquid melt container, such as a melting crucible, including such rotary sliding closure unit.

It is of course well known to employ sliding closure units on liquid melt containers, such as melting crucibles, to selectively discharge the liquid melt therefrom. Such sliding closure units are normally of the type wherein all of the elements of the unit are located outside of the liquid melt container. There have, however, been proposed various designs of rotary sliding closure units wherein the sliding surfaces, i.e., the sealing surfaces between the stationary refractory plate and the rotary refractory plate, are positioned within the metal jacket of the liquid melt container, i.e., on that side of the metal jacket facing towards the liquid melt within the container. Such proposals are disclosed for example in Austrian Pat. No. 165,292, Austrian Pat. No. 171,189, DE-OS 19 10 247, and DE-OS 20 43 588. The intended advantage, inter alia, of such proposals is to maintain the pouring area and the sliding surface of the closure unit constantly warm by means of the heat of the melt within the container and to thereby avoid solidification of the melt in such area. However, serious disadvantages are inherently attended with such proposals. Thus, the mounting and dismounting of the rotary sliding closure unit is cumbersome and difficult. Additionally, the refractory parts or elements employed in such units are hard to produce and are voluminous. As a practical matter, it has not yet been possible to effectively employ such type of rotary sliding closure unit.

SUMMARY OF THE INVENTION

With the above discussion in mind, it is an object of the present invention to provide an improved rotary sliding closure unit and a liquid melt container incorporating such rotary sliding closure unit, wherein the sliding or sealing surfaces between the stationary refractory plate and the rotary refractory plate are located interiorly of the metal jacket of the liquid melt container, while overcoming the disadvantages of prior art arrangements.

It is a further object of the present invention to provide such a rotary sliding closure unit and liquid melt container employing the same which are capable of simple and easy maintenance and rapid replacement and repair.

These objects are achieved in accordance with the present invention by the provision of a rotary sliding closure unit to be employed in a liquid melt container including an outer metal jacet, an inner refractory lining, and a pouring opening extending through the lining. The rotary sliding closure unit extends inwardly through the jacket and into the lining to selectively block and unblock the pouring opening. The rotary sliding closure unit includes a stationary refractory plate positioned within the lining and having therethrough a flow passage in communication with the pouring opening, and a rotary refractory plate positioned in sliding abutting contact with the stationary refractory plate and having therethrough at least one flow passage to be selectively moved into and out of alignment with the flow passage of the stationary refractory plate. The stationary and rotary refractory plates have complementary abutting relative sliding surfaces located within the interior of the outer metal jacket of the liquid melt container. A stationary support positions the stationary refractory plate within the lining and includes a stationary tube member extending through the jacket and into the lining. The stationary tube member has at an inner end thereof structure for fixedly grasping the stationary refractory plate. A rotary support positions the rotary refractory plate against the stationary refractory plate for rotational movement with respect thereto and includes an intermediate member fixedly grasping the rotary refractory plate and a rotary tube member extending through the jacket coaxially with respect to the stationary tube member. An inner end of the rotary tube member is connected to the intermediate member, such that the intermediate member is fixed with respect to the rotary tube member circumferentially thereof, whereby rotation of the rotary tube member imparts rotation to the intermediate member and to the rotary refractory plate. However, the intermediate member is capable of axial movement with respect to the rotary tube member. The intermediate member is axially urged with respect to the rotary tube member to thereby urge the rotary refractory plate toward the stationary refractory plate.

The rotary tube member extends through the stationary tube member. Bearings are positioned between the stationary and rotary tube members, exteriorly of the jacket, to axially and radially support the rotary tube member with respect to the stationary tube member. The stationary tube member includes a plurality of longitudinal tubular sections which are connected to each other with layers of thermal insulating material therebetween. An innermost detachable tubular section has a surface against which the stationary refractory plate is positioned. Such surface is formed on a radially inwardly extending flange and faces outwardly of the jacket. Such surface includes a step into which the stationary refractory plate is fitted. Two of the tubular sections have extending radially outwardly therefrom, at positions outwardly of the jacket, respective flanges which are detachably connected together. One such flange is employed to connect the rotary sliding closure unit to the jacket of the liquid melt container. One of the tubular sections having a flange is adapted to be positioned completely outwardly of the jacket and supports the rotary tube member.

The rotary tube member has connected thereto at a position outwardly of the jacket, a device for receiving rotation to thereby rotate the tubular member. Such device preferably has a bell-like configuration and extends around and covers the outer end of the stationary tube member. Such device further preferably has extending annularly therearound gear or sprocket teeth.

A thermal insulating member is supported by the intermediate member at a position outwardly of the rotary refractory plate. A refractory pouring spout extends from the thermal insulating member outwardly through the rotary tube member. The thermal insulating member and the pouring spout may be integrally formed as a single element or may be separately formed.

A plurality of bolts are connected to and extend from the inner end of the rotary tube member. Such bolts each have portions fitting within holes formed in the intermediate member. Such bolts are movable within such holes, thereby enabling relative axial movement between the rotary tube member and the intermediate member. Such bolts however transmit rotation of the rotary tube member to the intermediate member.

A plurality of push rods slidably extend through the rotary tube member and have inner ends abutting against the intermediate member and outer ends extending outwardly of the rotary tube member. A plate abuts the outer ends of the push rods, and springs urge the plate against the push rods, thereby urging the push rods to slide axially inwardly through the rotary tube member and against the intermediate member, thereby pressing the rotary refractory plate against the stationary refractory plate.

A key fixes the stationary refractory plate to the inner end of the stationary tube member to prevent relative rotation therebetween. Similarly, a key fixes the rotary refractory plate to the intermediate member to prevent relative rotation therebetween.

BRIEF DESCRIPTION OF THE DRAWINGS

Other objects, features and advantages of the present invention will be apparent from the following detailed description, taken with reference to the accompanying drawings, wherein.

DETAILED DESCRIPTION OF THE INVENTION

Figure 1:
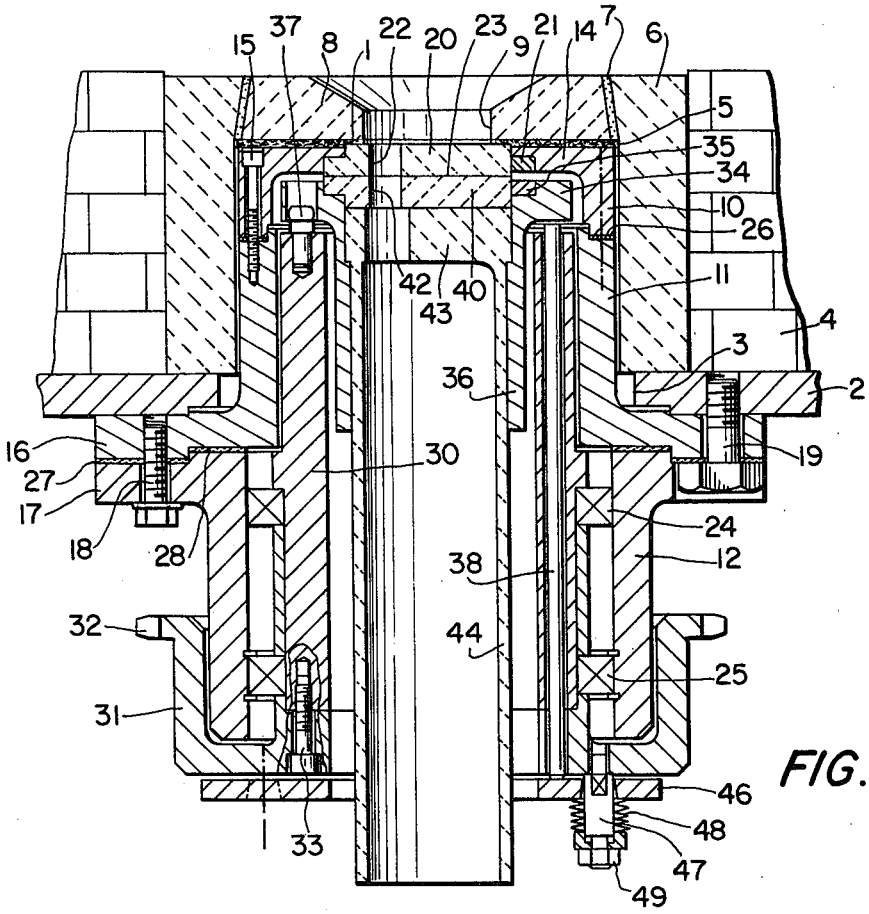
FIG. 1 is a longitudinal cross-sectional view through a rotary sliding closure unit mounted in a liquid melt crucible in accordance with the present invention.
Figure 2:
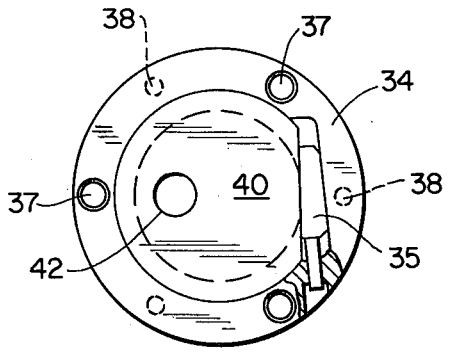
FIG. 2 is a top plan view, partially in section, illustrating the relationship of the intermediate member and the rotary refractory plate fitted therein.

With reference now to FIGS. 1 and 2, there is illustrated a liquid melt container, and specifically a metallurgical melting crucible, including an outer metal jacket 2 and an inner refractory lining 4. A refractory sleeve 6 is arranged at an opening 3 in the jacket 2. A discharge brick 8 is fitted within refractory sleeve 6 and has a wide funneled pouring opening 9. It will be apparent that the refractory elements 6 and 8 will normally remain in place within the crucible and generally need be replaced only when replacing the lining 4. Refractory elements 6 and 8 are connected by an annular joint 7, for example, of a refractory cement.

A rotary sliding closure unit extends through the opening 3 in jacket 2 and into the interior of refractory sleeve 6. Such unit includes a stationary refractory plate 20 which is separated from the lower or outer side of refractory brick 8 by means of an annular joint 1 which surrounds pouring opening 9 and a layer of insulating material 5, for example, formed of fireproof or refractory felt mat, arranged annularly around joint 1. It will be apparent that joint 1 and layer 5 must be replaced with each replacement or reinstallation of the rotary sliding closure unit.

A rotary refractory plate 40 is positioned in sliding abutting contact with the stationary refractory plate 20. Stationary refractory plate 20 has therethrough a flow passage 22 which is in communication with the pouring opening 9. Rotary refractory plate 40 has therethrough at least one flow passage 42 which, upon rotation of plate 40, may be selectively moved into and out of alignment with flow passage 22. Stationary refractory plate 20 and rotary refractory plate 40 have complementary abutting relative sliding surfaces 23 which are located within the interior of outer jacket 2. As will be apparent from FIG. 1, a substantial portion of the upper or inner surface of stationary refractory plate 20 is exposed to the melt within the crucible. Therefore, and due to the refractory plates being located inwardly of the jacket 2, the pouring or casting area for the melt is maintained at all times at a relatively high temperature. This will prevent solidification of the melt in the pouring or casting area. The plates 20 and 40 may be identical planar plate members. It of course will be understood however, that rotary refractory plate 40 may have therethrough a plurality of flow passages 42.

A stationary support supports the stationary refractory plate 20 within the lining. The stationary support includes a stationary tube member extending through the jacket 2 and into the lining. The stationary tube member in the illustrated embodiment includes a plurality of longitudinal tubular sections 10, 11 and 12 which are connected to each other with layers 26, 27, 28 of thermal insulation material therebetween. An innermost detachable tubular section 10 is connected to the next tubular section 11 by a plurality of bolts 15. Innermost tubular section 10 includes a radially inwardly extending flange 14 having a portion which faces outwardly toward the jacket. Such outwardly facing portion of flange 14 has formed therein a stepped surface into which fits the stationary refractory plate 20. A key 21 is employed to fix stationary refractory plate 20 with respect to flange portion 14 without relative rotation therebetween. Thermal insulating layers 26, 27, 28 highly restrict the dissipation of heat from the pouring or casting area toward the outside of the stationary tube member, which is formed of metal. Tubular sections 11,12 are formed with respective outwardly extending flanges 16 and 17, which are located at a position outwardly of jacket 2. Bolts 18 connect flanges 16 and 17 together. One flange, for exaple flange 16 of tubular section 11, has extending therethrough bolts 19 for connecting the entire rotary sliding closure unit to the jacket 2, or to an intermediate plate attached to jacket 2.

A rotary support supports the rotary refractory plate 40 against the stationary refractory plate 20 for rotational movement with respect thereto. The rotary support includes an intermediate member 34 having formed therein a stepped surface for receiving rotary refractory plate 40. A key 35 keys rotary refractory plate 40 to intermediate member 34 to prevent relative rotation therebetween. The rotary support further includes a rotary tube member 30 which extends generally coaxially through the stationary tube member. A plurality of bolts 37 are threaded into the inner end of rotary tube member 30 and extend upwardly therefrom. Bolts 37 have portions, for example heads, which fit within holes or bore holes formed in intermediate member 34. By this arrangement, relative sliding movement is enabled between intermediate member 34 and the heads of bolts 37 and rotary tube member 30. However, upon rotation of rotary tube 30, the heads of bolts 37 transmit such rotation to intermediate member 34.

Bearings 24 and 25 axially and radially support the rotary tube member 30 on tubular section 12 of the stationary tube member which is positioned entirely outwardly of the jacket 2. A rotation receiving device 31 has a generally bell-like configuration and is attached, for example, by bolts 33, to the outer end of rotary tube member 30. Such bell-like configuration of device 31 extends radially outwardly and then axially to surround and cover the outer end of the stationary tube member. The end of bell-like device 31 is provided with gear or sprocket teeth 32 positioned axially between the locations of bearings 24 and 25 and can receive rotation, for example by means of a chain or spur gear, to rotate rotary tube member 30, intermediate member 34 and rotary refractory plate 40.

A thermal insulating member 43 is supported by intermediate member 34 at a position outwardly adjacent of rotary refractory plate 40. Member 43 has therethrough a flow passage communicating with flow passage 42 in plate 40. Member 43 rotates with intermediate member 34 and plate 40. A pouring spout 44 extends outwardly from member 43 and extends through the rotary tube member 30 to protect the various metal components from the heat of a discharged melt. As illustrated, pouring spout 44 may be generally coaxially supported by tubular sleeve 36 extending from intermediate member 34. The thermal insulating member 43 and the pouring spout 44 may be integrally formed as a single element, as illustrated in FIG. 1, or may be formed of separate elements. Elements 43 and 44 would be formed of suitable refractory material and may be formed of light and porous fibrous and flaked refractory material.

Structure is provided to urge the rotary refractory plate 40 against the stationary refractory plate 20. Specifically, a plurality of push rods 38, circumferentially staggered and spaced with bolts 37 as indicated in FIG. 2, may slidably axially extend through rotary tube member 30. Push rods 37 have inner ends abutting against the intermediate member 34 and outer ends which extend outwardly of the rotary tube member 30. A ring-shaped plate member 46 abuts the outer ends of push rods 37. Springs urge plate 46 against the push rods 37 and thus against intermediate member 34 to urge plate 40 tightly against plate 20. Such springs may be, as illustrated in FIG. 1, three spring elements 48 in the form of cup springs which are arranged in layers on respective spacer bolts 47 and tightened by nuts 49 against plate 46. By this arrangement, it is easily possible to provide a desired surface pressure between plates 40 and 20.

It will be apparent from the above description and from FIG. 1 that the rotary refractory plate 40 and the intermediate support 34 are capable of relative tilting movement with respect to movement tube 30, upon rotation of member 30. Thus, upon rotation of rotary tube member 30, even if member 30 is not precisely coaxially aligned with the stationary tube member, a constant and uniform planar pressure will be maintained between the plates 40 and 20, without any relative tilting or twisting between the plates.

The rotary sliding closure unit as a whole can easily be dismantled from the recess formed by the refractory members 6 and 8 of the crucible by loosening and/or removing bolts 19. In this manner, when the unit as a whole is removed, bolts 15 become accessible and the end section 10 of the stationary support can be removed to inspect or exchange plates 20 and/or 40. Thereafter, the end tubular section 10 is replaced with bolts 15, the spring elements 48 are adjusted as necessary, and the entire unit can again be installed within the crucible.

Additionally, however, it would be possible to leave bolts 19 in their attached position and to loosen or remove bolts 18 connecting flanges 16 and 17. This would allow the tubular section 12 and the rotary portions of the unit to be dismantled. Tubular sections 11,10 and the stationary refractory plate 20 would remain in position.

It will be apparent from the above discussion that the rotary sliding closure unit of the present invention is capable of uniquely simple maintenance, and particularly enables the very rapid exchange of refractory plates 20 and 40. The unit can be very easily adapted to be accommodated into crucible recesses of varying depth or to accommodate varying positions of sliding surfaces 23. Thus, this can be achieved merely by changing the lengths of tubular section 11 and rotary tube member 30. Such could also be achieved merely by employing intermediate spacer rings between the various elements.

The rotary sliding closure unit of the present invention can be employed for the pouring or casting of different types of liquid melts, particularly of non-ferrous heavy metals or light metals from respective melting crucibles or containers. Such operation is possible not only in the vertical position or direction as indicated in FIG. 1, but also by arranging the unit to have a horizontal or inclined rotating axis.

Although the present invention has been described and illustrated with respect to a preferred embodiment thereof, it is to be understood that various modifications and changes may be made without departing from the scope of the present invention.

What is claimed is:

1. In a liquid melt container including an outer jacket, an inner refractory lining, a pouring opening extending through said lining, and a rotary sliding closure unit extending inwardly through said jacket and into said lining for selectively blocking and unblocking said pouring opening, the improvement wherein said rotary sliding closure unit comprises:

a stationary refractory plate positioned within said lining and having therethrough a flow passage in communication with said pouring opening;

a rotary refractory plate positioned in sliding abutting contact with said stationary refractory plate and having therethrough at least one flow passage to be selectively moved into and out of alignment with said flow passage of said stationary refractory plate;

said stationary and rotary refractory plates having complementary, abutting relative sliding surfaces located within the interior of said outer jacket;

stationary support means for supporting said stationary refractory plate within said lining, said stationary support means comprising a stationary tube member extending through said jacket and into said lining, said stationary tube member having at an inner end thereof means for fixedly grasping said stationary refractory plate;

rotary support means for supporting said rotary refractory plate against said stationary refractory plate for rotational movement with respect thereto, said rotary support means comprising an intermediate member fixedly grasping said rotary refractory plate, and a rotary tube member extending through said jacket coaxially with respect to said stationary tube member;

means for connecting an inner end of said rotary tube member to said intermediate member, such that said intermediate member is fixed with respect to said rotary tube member circumferentially thereof, whereby rotation of said rotary tube member imparts rotation to said intermediate member and said rotary refractory plate, but such that said intermediate member is capable of axial movement with respect to said rotary tube member; and tensioning means for urging said intermediate member axially with respect to said rotary tube member and for thereby urging said rotary refractory plate toward said stationary refractory plate.

2. The improvement claimed in claim 1, wherein said rotary tube member extends through said stationary tube member, and further comprising bearing means axially and radially supporting said rotary tube member with respect to said stationary tube member.

3. The improvement claimed in claim 1, wherein said stationary tube member comprises plural longitudinal tubular sections connected to each other with layers of thermal insulating material therebetween.

4. The improvement claimed in claim 3, wherein said stationary tube member includes an innermost detachable tubular section having a surface against which said stationary refractory plate is positioned.

5. The improvement claimed in claim 4, wherein said innermost detachable tubular section includes a radially inwardly extending flange having formed in a portion thereof facing outwardly of said jacket said surface, said surface including a step into which said stationary refractory plate is fitted.

6. The improvement claimed in claim 3, wherein two of said tubular sections have extending radially outwardly therefrom, at positions outwardly of said jacket, respective flanges, and further comprising means for detachably connecting said flanges.

7. The improvement claimed in claim 6, further comprising means for detachably connecting one of said flanges to said jacket.

8. The improvement claimed in claim 6, wherein one of said two tubular sections is positioned completely outwardly of said jacket and supports said rotary tube member.

9. The improvement claimed in claim 1, further comprising rotation receiving means, connected to said rotary tube member at a position outwardly of said jacket, for rotating said rotary tube member.

10. The improvement claimed in claim 9, wherein said rotation receiving means has a bell-like configuration and extends around and covers an outer end of said stationary tube member.

11. The improvement claimed in claim 9, wherein said rotation receiving means has extending annularly therearound gear or sprocket teeth.

12. The improvement claimed in claim 1, further comprising a thermal insulating member supported by said intermediate member outwardly of said rotary refractory plate.

13. The improvement claimed in claim 12, further comprising a refractory pouring spout extending from said thermal insulating member outwardly through said support means.

14. The improvement claimed in claim 13, wherein said thermal insulating member and said pouring spout are integrally formed as a single element.

15. The improvement claimed in claim 1, wherein said connecting means comprise a plurality of bolts connected to and extending from said inner end of said rotary tube member, said bolts each having portions fitting within holes within said intermediate member for relative axial movement therebetween.

16. The improvement claimed in claim 1, wherein said tensioning means comprises a plurality of push rods slidably extending through said rotary tube member, said push rods having inner ends abutting against said intermediate member and outer ends extending outwardly of said rotary tube member, and means for urging said push rods axially inwardly of said rotary tube member and against said intermediate member.

17. The improvement claimed in claim 16, wherein said push rod urging means comprises a plate abutting said outer ends of said push rods, and springs urging said plate against said push rods.

18. The improvement claimed in claim 1, wherein said grasping means at said inner end of said stationary tube member comprises a key fixing said stationary refractory plate to said stationary tube member and preventing relative rotation therebetween.

19. The improvement claimed in claim 1, further comprising key means for fixing said rotary refractory plate to said intermediate member and preventing relative rotation therebetween.

20. The improvement claimed in claim 1, wherein said stationary refractory plate has an inner surface facing the interior of said liquid melt container, and a substantial portion of said inner surface is exposed to a liquid melt within said liquid melt container through said pouring opening.

21. A rotary sliding closure unit for use in a liquid melt container of the type including an outer jacket, an inner refractory lining, and a pouring opening extending through the lining, said rotary sliding closure unit being adapted to extend inwardly through the jacket and into the lining for selectively blocking and unblocking the pouring opening, said rotary sliding closure unit comprising:

a stationary refractory plate adapted to be positioned within the lining and having therethrough a flow passage adapted to be in communication with the pouring opening;

a rotary refractory plate positioned in sliding abutting contact with said stationary refractory plate and having therethrough at least one flow passage to be selectively moved into and out of alignment with said flow passage of said stationary refractory plate;

said stationary and rotary refractory plates having complementary, abutting relative sliding surfaces adapted to be located within the interior of the outer jacket;

stationary support means for supporting said stationary refractory plate within the lining, said stationary support means comprising a stationary tube member adapted to extend through the jacket and into the lining, said stationary tube member having at an inner end thereof means for fixedly grasping said stationary refractory plate;

rotary support means for supporting said rotary refractory plate against said stationary refractory plate for rotational movement with respect thereto, said rotary support means comprising an intermediate member fixedly grasping said rotary refractory plate, and a rotary tube member adapted to extend through the jacket coaxially with respect to said stationary tube member;

means for connecting an inner end of said rotary tube member to said intermediate member, such that said intermediate member is fixed with respect to said rotary tube member circumferentially thereof, whereby rotation of said rotary tube member imparts rotation to said intermediate member and said rotary refractory plate, but such that said intermediate member is capable of axial movement with respect to said rotary tube member; and tensioning means for urging said intermediate member axially with respect to said rotary tube member and for thereby urging said rotary refractory plate toward said stationary refractory plate.

22. A rotary sliding closure unit as claimed in claim 21, wherein said rotary tube member extends through said stationary tube member, and further comprising bearing means axially and radially supporting said rotary tube member with respect to said stationary tube member.

23. A rotaary sliding closure unit as claimed in claim 21, wherein said stationary tube member comprises plural longitudinal tubular sections connected to each other with layers of thermal insulating material therebetween.

24. A rotary sliding closure unit as claimed in claim 23, wherein said stationary tube member includes an innermost detachable tubular section having a surface against which said stationary refractory plate is positioned.

25. A rotary sliding closure unit as claimed in claim 24, wherein said innermost detachable tubular section includes a radially inwardly extending flange having formed in a portion thereof facing outwardly of said jacket said surface, said surface including a step into which said stationary refractory plate is fitted.

26. A rotary sliding closure unit as claimed in claim 23, wherein two of said tubular sections have extending radially outwardly therefrom, at positions adapted to be outwardly of the jacket, respective flanges, and further comprising means for detachably connecting said flanges.

27. A rotary sliding closure unit as claimed in claim 26, further comprising means for detachably connecting one of said flanges to the jacket.

28. A rotary sliding closure unit as claimed in claim 26, wherein one of said two tubular sections is adapted to be positioned completely outwardly of the jacekt and supports said rotary tube member.

29. A rotary sliding closure unit as claimed in claim 21, further comprising rotation receiving means, connected to said rotary tube member at a position adapted to be outwardly of the jacket, for rotating said rotary tube member.

30. A rotary sliding closure unit as claimed in claim 29, wherein said rotation receiving means has a bell-like configuration and extends around and covers an outer end of said stationary tube member.

31. A rotary sliding closure unit as claimed in claim 29, wherein said rotation receiving means has extending annularly therearound gear or sprocket teeth.

32. A rotary sliding closure unit as claimed in claim 21, further comprising a thermal insulating member supported by said intermediate member outwardly of said rotary refractory plate.

33. A rotary sliding closure unit as claimed in claim 32, further comprising a refractory pouring spout extending from said thermal insulating member outwardly through said support means.

34. A rotary sliding closure unit as claimed in claim 33, wherein said thermal insulating member and said pouring spout are integrally formed as a single element.

35. A rotary sliding closure unit as claimed in claim 21, wherein said connecting means comprise a plurality of bolts, connected to and extending from said inner end of said rotary tube member, said bolts each having portions fitting within holes within said intermediate member for relative axial movement therebetween.

36. A rotary sliding closure unit as claimed in claim 21, wherein said tensioning means comprises a plurality of push rods slidably extending through said rotary tube member, said push rods having inner ends abutting against said intermediate member and outer ends extending outwardly of said rotary tube member, and means for urging said push rods axially inwardly of said rotary tube member and against said intermediate member.

37. A rotary sliding closure unit as claimed in claim 36, wherein said push rod urging means comprises a plate abutting said outer ends of said push rods, and springs urging said plate against said push rods.

38. A rotary sliding closure unit as claimed in claim 21, wherein said grasping means at said inner end of said stationary tube member comprises a key said stationary refractory plate to said stationary tube member and preventing relative rotation therebetween.

39. A rotary sliding closure unit as claimed in claim 21, further comprising key means for fixing said rotary refractory plate to said intermediate member and preventing relative rotation therebetween.

* * * * *